US005769420A

United States Patent [19]

Sultzbaugh

[11] Patent Number: 5,769,420

[45] Date of Patent: Jun. 23, 1998

[54] METHOD OF PLAYING A BOARD GAME

[76] Inventor: Caroline R. Sultzbaugh, 16 Stonebriar Way, Frisco, Tex. 75034

[21] Appl. No.: 864,764

[22] Filed: May 28, 1997

[51] Int. Cl.[6] ..... A63F 3/00

[52] U.S. Cl. ..... 273/249; 273/273; 273/303

[58] Field of Search ..... 273/249, 273, 273/440, 292, 303

[56] References Cited

U.S. PATENT DOCUMENTS 4,993,718 2/1991 Dandridge et al. ..... 273/249

OTHER PUBLICATIONS

"The Way To Play", Diagram Group, Menagerie and Snap, p. 304, 1975.

*Primary Examiner*—Benjamin H. Layno

*Attorney, Agent, or Firm*—Jones, Day, Reavis & Poque

[57] ABSTRACT

A method of playing a novel board game wherein player pieces are moved along a predetermined path in accordance with the ability of one player to remember a fictitious name selected by the other player before the game begins. Cards are dealt in sequence to all the players to form a card pile face up in front of each player. When the last played card matches a card previously paid, those two players try to recall and say the other player's name first. The player who says the other player's name first takes the other's card pile, counts the number of cards in it, and advances a corresponding number of spaces on the playing board. The player who reaches the finish location first, either one or more times, is the winner.

16 Claims, 3 Drawing Sheets

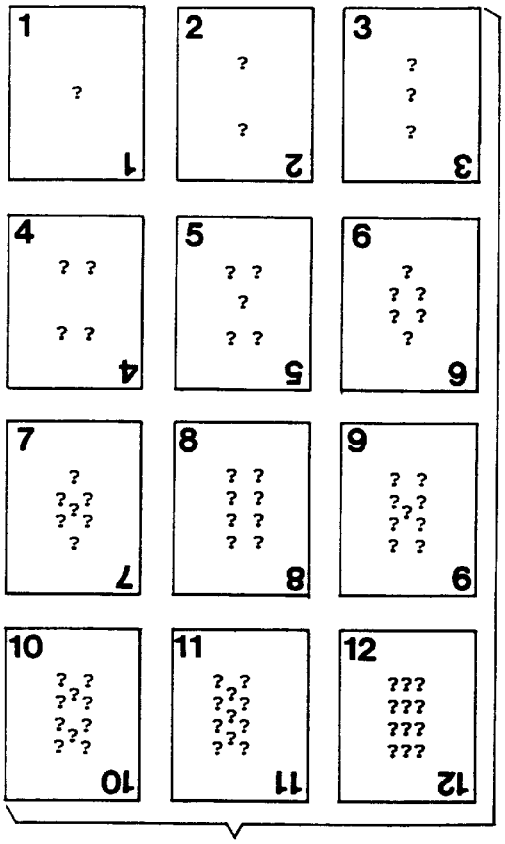

FIG. 3

WHAT'S YOUR NAME AGAIN?
Level Three Names
#4

BABY HUEY
BOOGIE-WOOGIE
COOCHIE COOCHIE
EASY MONEY
HANKY-PANKY
HEAVY-DUTY
HOLY MOLLY
HUMPTY DUMPTY
ITSY-BITSY
JURY DUTY
LOOSEY-GOOSEY
LOUIE LOUIE
LOVEY-DOVEY
MESSY BESSY
OKEY-DOKEY
TOPSY-TURVY
UPSY-DAISY
WALKIE-TALKIE
WILLY-NILLY
WILLY-WALLY

FIG. 6

WHAT'S YOUR NAME AGAIN?
Level One Names

| #3 | #4 |
|---|---|
| AH CHOO | BANSHEE |
| BAMBOO | BINGO |
| BOO-HOO | BOZO |
| BRAND NEW | BUNJEE |
| BLESS YOU | CONGO |
| CASHEW | FONZIE |
| CAN DO | GIZMO |
| CANOE | GONZO |
| GUMSHOE | GOTCHA |
| KAZOO | GRIZZLY |
| KUNG FU | GUMBO |
| OLD SHOE | JUMBO |
| SHAMPOO | KAZOO |
| SKY-BLUE | KUDZU |
| SNOWSHOE | MAMBO |
| TABOO | MANGO |
| TATTOO | NINJA |
| TRUE BLUE | PIZZA |
| VOODOO | RUMBA |
| YAHOO | TANGO |

FIG. 4

WHAT'S YOUR NAME AGAIN?
Level Two Names

| #6 | #7 |
|---|---|
| A-OK | APRES-SKI |
| B & B | BUMBLEBEE |
| B.L.T. | BLACKEYED PEA |
| C.E.O. | C'EST LA VIE |
| C.I.A. | CUP OF TEA |
| C.O.D. | CHRISTMAS TREE |
| C.P.A. | DO RE MI |
| K.G.B. | DUTY-FREE |
| I.O.U. | FANCY FREE |
| M.V.P. | FINDER'S FEE |
| Ps & Qs | LET IT BE |
| P.T.A. | MAITRE D' |
| R & R | MONEY TREE |
| S.O.S | PARDON ME |
| T.L.C | POTPOURRI |
| T.N.T. | SHOPPING SPREE |
| T.K.O. | SUGAR-FREE |
| Triple A | SPELLING BEE |
| U.S.A. | THIRD-DEGREE |
| V.I.P. | TWIDDLEDEE |

FIG. 5

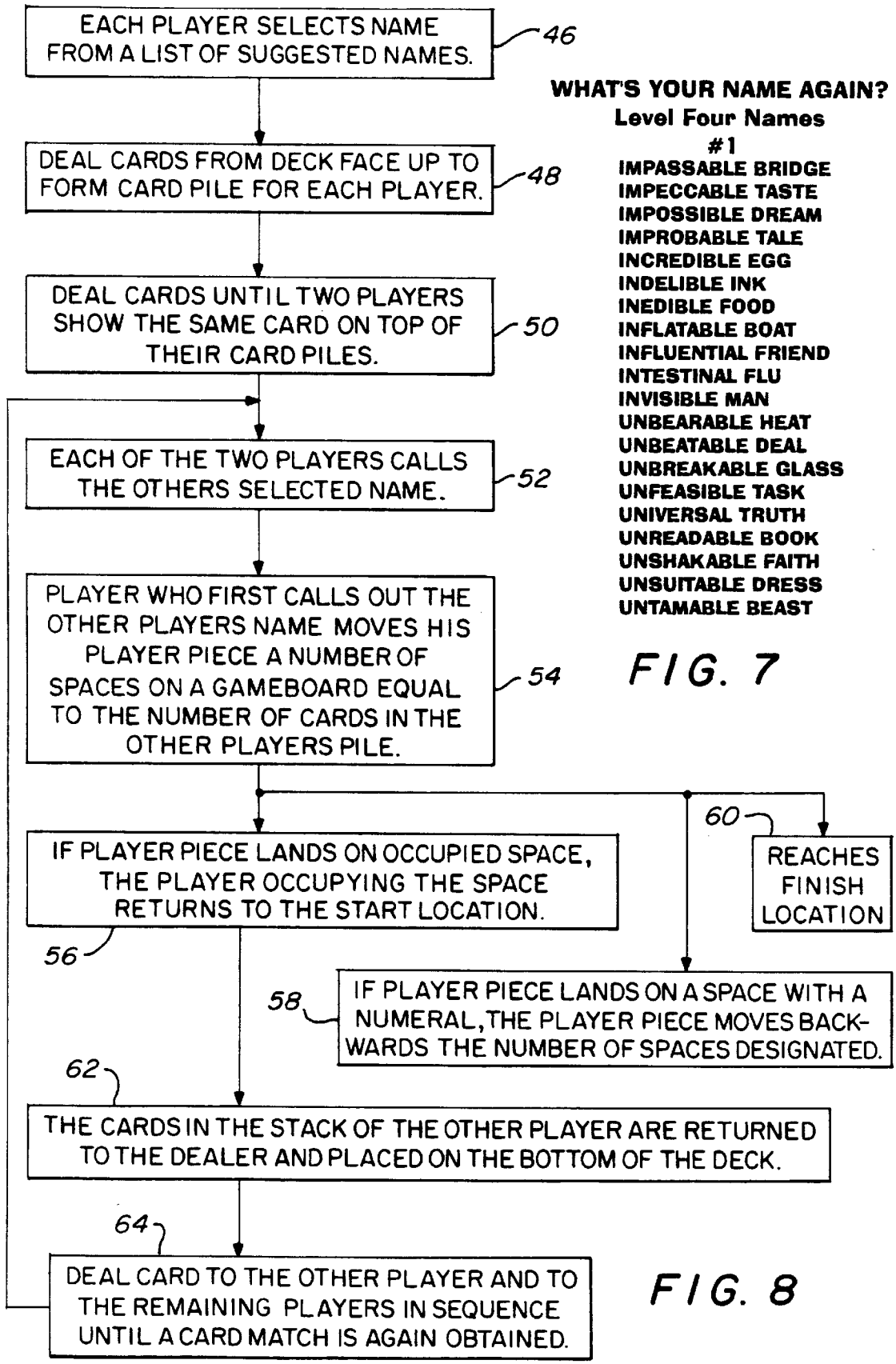

WHAT'S YOUR NAME AGAIN?
Level Four Names
#1

IMPASSABLE BRIDGE
IMPECCABLE TASTE
IMPOSSIBLE DREAM
IMPROBABLE TALE
INCREDIBLE EGG
INDELIBLE INK
INEDIBLE FOOD
INFLATABLE BOAT
INFLUENTIAL FRIEND
INTESTINAL FLU
INVISIBLE MAN
UNBEARABLE HEAT
UNBEATABLE DEAL
UNBREAKABLE GLASS
UNFEASIBLE TASK
UNIVERSAL TRUTH
UNREADABLE BOOK
UNSHAKABLE FAITH
UNSUITABLE DRESS
UNTAMABLE BEAST

FIG. 7

FIG. 8

METHOD OF PLAYING A BOARD GAME

BACKGROUND OF THE INVENTION

1. Field of The Invention

The present invention relates in general to games and in particular to a method of playing a board game whereby a player piece is moved along a predetermined path in accordance with the ability of the first of two players to call out a selected name of the other player when cards being dealt to the two players match.

2. Description of Related Art Including Information Disclosed Under 37 CFR 1.97 AND 1.98

There are many different types of board games using player pieces that move along a predetermined path and that are played by a plurality of players.

However, no games are known to applicant whereby the movement of the player piece along a predetermined path is determined by the ability of the first of two players to recall a predetermined selected name of the second other player when cards being dealt to the first and second players match.

SUMMARY OF THE INVENTION

The present invention relates to a board game having a board with a path thereon for movement of player pieces along a plurality of spaces marked on the path from a START to a FINISH. Before the game begins, each player selects a fictitious name from a prepared list of suggested names with each person revealing his selected name to all other players. Cards are dealt sequentially to each player from a deck having a plurality of matching cards to form a card stack for each player. When the last card dealt on the card stack of a first player matches the last card previously dealt on the card stack of a second other player, each of the first and second players attempts to be the first to call out the selected name of the other player. The one to do so moves his player piece a number of spaces along the predetermined path that is equal to the number of cards in the card stack of the other player.

The deck of cards may be formed with a plurality of matching cards of X identical groups of a font of Y different cards. In the preferred embodiment, X=8 and Y=10. Thus each deck is formed with 80 cards. In each deck there are 8 identical cards of each one of the 10 different cards.

A list of suggested names to be chosen is provided with each player selecting a name from the list and each player revealing the selected name to all other players to enable each player to memorize the name of all the other players. Each name in a list may be related by a commonalty such as sounds, letters, and the like. Examples are "AH CHOO", "BAMBOO", "BOO-HOO", and the like.

In addition, a plurality of lists of suggested names may be provided with each list of suggested names having a varying level of difficulty of recall.

Further, indicia is formed on selected ones of the path spaces such that a player piece moving to the indicia-bearing space must further move according to instructions thereon. If, for instance, the instruction is to move back one space, two spaces, or three spaces, then the player landing on that space must move according to the directions thereon.

Further, a first player whose player piece is on a space must return to the START position if the player piece of a second player subsequently moves to the same space.

In addition, the Y different cards may have similar designs with different color combinations or geometric patterns to confuse the player identification of matching cards. The Y cards, for instance, may have similar triangular and rectangular geometric patterns such as the font of cards shown in FIG. 2. For a faster moving game, the cards may have numerals and other designs thereon as shown in FIG. 3.

The predetermined path having the plurality of spaces thereon may be in the shape of a spiral beginning with the START at the outer edge of the spiral and ending at a FINISH at the inner end of the spiral.

To make the game interesting, the method includes the step of placing a limit on the time the players have to memorize the names of all the other players.

Thus, it is an object of the present invention to provide a method of playing a board game with a plurality of players comprising the steps of providing a board with a path for movement of player pieces along a plurality of spaces marked on the path from a START to a FINISH, each player selecting a name other than the player's own name, the selected name of each player being told to all other players, sequentially dealing cards to each player from a deck having a plurality of matching cards to form a card stack for each player until the last card dealt on the card stack of a first player matches the last card previously dealt on the card stack of a second player, and moving the player piece of one of the first or second players who first calls out the selected name of the other player a number of spaces along the path equal to the number of cards in the card stack of the other player.

BRIEF DESCRIPTION OF THE DRAWINGS

These and other features of the present invention will be more fully disclosed when taken in conjunction with the following DETAILED DESCRIPTION OF THE PREFERRED EMBODIMENT in which like numerals represent like elements and in which:

FIG. 3 is a font of 12 cards having numbers thereon to enable the game to move faster;

FIGS. 4, 5, 6, and 7 are suggested lists of names having increasing degrees of difficulty in memorization thereof; and FIG. 8 is a flow chart setting forth the novel steps of the present invention.

DETAILED DESCRIPTION OF THE PREFERRED EMBODIMENT

Figure 1:
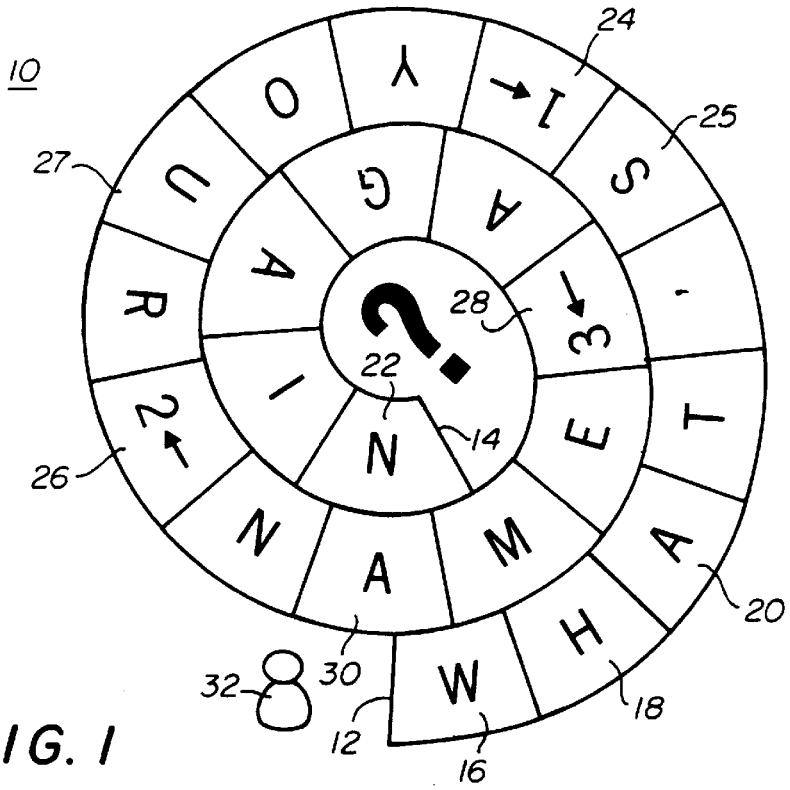
FIG. 1 is a plan view of the novel game board of the present invention.

FIG. 1 is a plan view of the preferred embodiment of the board 10 forming the basis of the novel board game of the present invention. It has a path formed of a plurality of spaces 16, 18, and 20 through space 22 that extend from a START line 12 and end at a FINISH line 14. It will be noted that space 24 has a 1 thereon with an arrow pointing in the direction of the START line 12. This indicates that if a player piece lands on space 24, it must move backwards one space to space 25. In like manner, if a player piece lands on space 26, marked 2 with an arrow pointing in the direction of the START line 12, the player piece must move backwards two spaces to space 27. Again, if a player piece lands on space 28, which has a 3 thereon and an arrow pointing in the direction of START line 12, the player piece must move backwards three spaces to space 30.

It will be noted in FIG. 1 that the board 10 has the path with the plurality of spaces arranged in a spiral shape from the START line 12 to the FINISH line 14. It could just as well be any other desired shape, such as rectangular or circuitous. A player piece 32, of any desired shape, may be used to represent each player in the game. The player pieces may be preferably of different colors to identify the different players.

Figure 2:
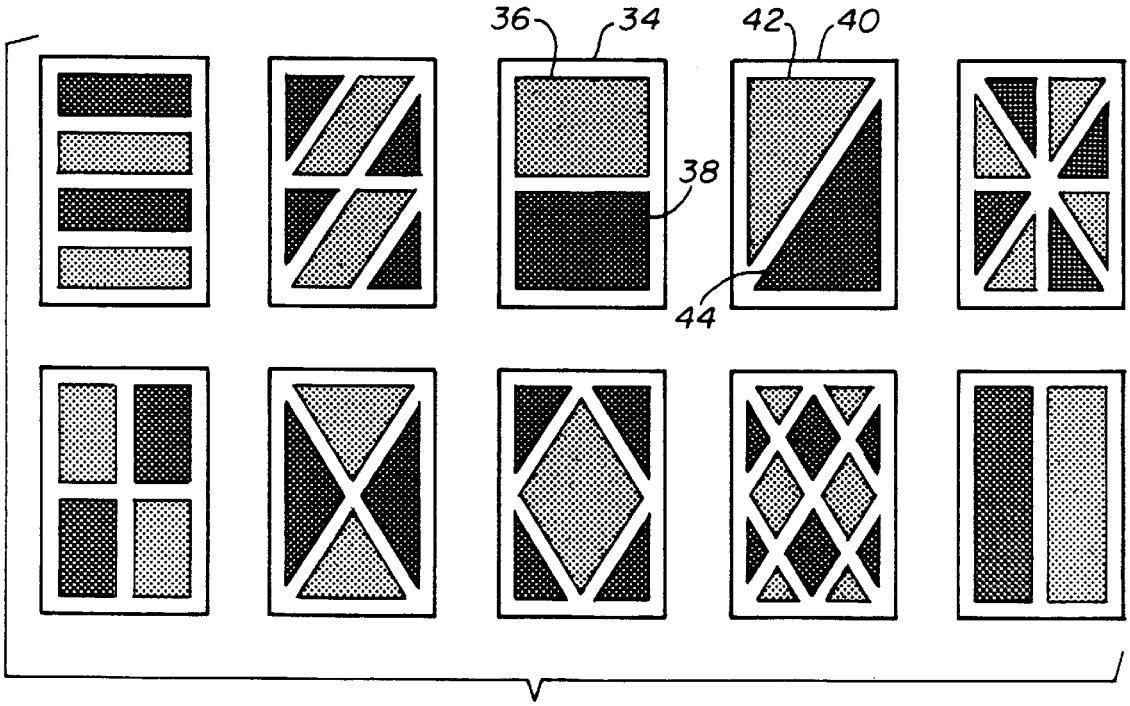
FIG. 2 sets forth a font of ten cards illustrating the similar designs formed with similar geometric patterns thereon to confuse the players.

FIG. 2 illustrates a font of 10 different cards forming one set of cards. Preferably 8 identical sets of the ten cards are used to form one deck such that each of the cards shown in FIG. 2 will repeat itself eight times. Note that the cards have similar geometric designs such as rectangles, triangles, and parallelograms. In addition, the cards may have similar designs with various color combinations to confuse player identification of matching cards. Thus card 34 could have a first square 36 that is of a color such a yellow, while square 38 could be red. In like manner, card 40 could have a triangle 42 that is yellow and a second triangle 44 that is red. These two cards, because of the colors, could be confused for a short time when the cards are played causing players to believe there is a match when in fact there is not.

FIG. 3 illustrates a font of 12 different cards that are numbered 1–12 and that are numbered in sequence. Each card has indicia thereon, such as the question mark shown, that corresponds in number to the card number. Thus, the "1" card has one question mark, the "2" card has two questions marks, and so on. The numbering of the cards reduces the confusion, and enables the game to move at a faster pace. As an example only, six of such fonts could be used to make a deck of 72 cards.

FIGS. 4, 5, 6, and 7 are suggested lists of names from which the players can select a name for a given game. The names in FIG. 4 are of a first level of difficulty to memorize. The names in FIG. 5 are of a second level that are more difficult to recall. In like manner, FIGS. 6 and 7 have increasingly difficult names to remember. Of course, these names are merely suggested names and other names could be provided.

The method of playing the novel game is illustrated in FIG. 8. At step 46, each player selects a name from a list of suggested names. At step 48, cards are dealt from a deck face up to form a card pile for each player. At step 50, the cards are dealt sequentially until two players have the same card on top of their card piles. At step 52, each of the two players having the same card attempts to call out the selected name of the other player. At step 54, the player who first calls out the other player's selected name moves his player piece a number of spaces on the game board equal to the number of cards in the other player's card pile.

Three things may then happen. At step 56, if the player piece lands on an occupied space, the player occupying the space returns his player piece to the START location. At step 58, if the player piece lands on a space containing a numeral, the player piece moves backwards the number of spaces designated by the numeral. The third alternative, at step 60, occurs when the player piece reaches the FINISH location. The player whose player piece first reaches the FINISH location wins that round of play. A player may be required to win one or more rounds before being the winner of the game.

If the game continues to play and no player reaches the FINISH location, at step 62, the cards in the stack of the other player are returned to the dealer and placed on the bottom of the deck. At step 64, cards are then dealt to the other player and to the remaining players in sequence until a card match is again obtained. At that point the game returns, as indicated by line 66, to step 52 where each of the two player having the match again attempts to call out the other's selected name. The game then repeats itself until someone reaches the FINISH location at step 60 one or more times.

Thus, there has been disclosed a method of playing a board game with a plurality of players wherein cards are sequentially dealt to each player from a deck having a plurality of matching cards to form a card pile for each player until the last card dealt on the card pile of a first player matches the last card previously dealt on the card pile of a second player. The two players having the matching cards attempt to call out the other player's name that has been selected from a list of suggested names. The player piece of the one of the first and second players who first calls out the selected name of the other player moves his player piece a number of spaces along a path on a game board equal to the number of cards in the card stack of the other player. The deck may have a plurality of matching cards of X identical groups of a font of Y different cards and, in the preferred embodiment, there are eight identical groups of a font of ten different cards.

The game is made more interesting by providing a list of suggested names to be selected with each player selecting a name from the list and each player revealing that name to all of the other players to enable each other player to memorize the names of all other players.

The game is made more interesting by relating each name in a list by a commonalty such as by sounds, letters, and the like.

The game is further made more interesting by forming the Y cards with similar designs such as similar geometric patterns or different color combinations to confuse the player identification of matching cards.

The game can be played at a faster pace by using a deck of cards.

The corresponding structures, materials, acts, and equivalents of all means or step plus function elements in the claims below are intended to include any structure, material, or act for performing the function in combination with other claimed elements as specifically claimed.

What is claimed is:

1. A method of playing a board game with a plurality of players comprising the steps of:

providing a board with a path for movement of player pieces along a plurality of spaces marked on said path from a START location to a FINISH location;

each player selecting a name other than the player's own name, said selected name of each player being told to all other players;

sequentially dealing cards to each player from a deck having a plurality of matching cards to form a card pile for each player until the last card dealt on the card pile of a first player matches the last card previously dealt on the card pile of a second player; and moving the player piece of one of the first and second players who first calls out the selected name of the other player a number of spaces along said path equal to the number of cards in the card pile of the other player.

2. The method of playing a board game as in claim 1 further including the step of forming said deck having said plurality of matching cards of X identical groups of a font of Y different cards.

3. The method of playing a board game as in claim 2 wherein X=8 and Y=10.

4. The method of playing a board game as in claim 2 wherein the step of forming a font of Y different cards further comprises the step of forming the Y cards with similar designs having various color combinations to confuse the player identification of matching cards.

5. The method of playing a board game as in claim 4 wherein the step of forming the Y cards with similar designs further comprises the step of forming the Y cards with similar geometric patterns.

6. The method of playing a board game as in claim 5 wherein the step of forming Y cards with similar triangular and rectangular patterns further comprises the step of forming a font of ten cards as shown in FIG. 2.

7. The method of claim 2 wherein X=6 and Y=12.

8. The method of claim 7 wherein the step of forming a font of Y different cards further comprises the step of sequentially numbering the font of cards from 1–12.

9. The method of playing a board game as in claim 1 wherein the step of selecting a name for each player further comprises the steps of:

providing a list of suggested names;

each player selecting a name from said list; and each player revealing the selected name to all the other players to enable each player to memorize the names of all other players.

10. The method of playing a board game as in claim 9 further comprising the step of relating each name in the list by a commonalty such as by sounds or letters.

11. The method of playing a board game as in claim 9 further comprising the step of providing a plurality of lists of suggested names to be selected, each list of suggested names having a varying level of difficulty of recall.

12. The method of playing a board game as in claim 9 further including the step of placing a limit on the time the players have to memorize the names of all the other players.

13. The method of claim 1 further including the step of forming indicia on selected ones of the path spaces such that a player piece moving to said indicia-bearing space must further move according to instructions thereon.

14. The method of claim 13 further including the step of forming said indicia to cause a player piece moving thereto to further move backwards a predetermined number of spaces.

15. The method of playing a board game as in claim 1 further including the step of requiring a first player whose player piece is on a space to return to START if the player piece of a second player subsequently moves to the same space.

16. The method of playing a board game as in claim 1 further including the step of forming said path in a spiral shape from said START location to said FINISH location.

* * * * *